US005256933A

United States Patent [19]

Jeon

[11] Patent Number: 5,256,933

[45] Date of Patent: Oct. 26, 1993

[54] ELECTRON GUN FOR A CATHODE RAY TUBE

[75] Inventor: Gwan C. Jeon, Chungcheongbuk, Rep. of Korea

[73] Assignee: Samsung Electron Devices Co., Ltd., Kyungki-Do, Rep. of Korea

[21] Appl. No.: 814,488

[22] Filed: Dec. 30, 1991

[30] Foreign Application Priority Data

Dec. 31, 1990 [KR] Rep. of Korea ..... 90-22539

[51] Int. Cl.[5] ..... H01J 29/51

[52] U.S. Cl. ..... 313/414

[58] Field of Search ..... 313/414, 412, 449

[56] References Cited

U.S. PATENT DOCUMENTS 4,825,120 4/1989 Takahashi ..... 313/414

FOREIGN PATENT DOCUMENTS 60-202640 10/1985 Japan .

*Primary Examiner*—Sandra L. O'Shea

*Attorney, Agent, or Firm*—Cushman, Darby & Cushman

[57] ABSTRACT

An electron gun for a cathode ray tube for condensing the electric beam in a color cathode ray tube having an in-line type electron gun. The electron gun includes at least one floating electrode installed between two predetermined axially neighboring ones of the electrodes, so that the gap between these two predetermined electrodes can be increased. As a result, focusing voltage difference can be greatly reduced and the amount of a spherical aberration can be reduced, thereby improving the resolution of the cathode ray tube.

2 Claims, 2 Drawing Sheets

ELECTRON GUN FOR A CATHODE RAY TUBE

BACKGROUND OF THE INVENTION

The present invention relates to an electron gun for a cathode ray tube and, more particularly, to an electron gun for improving the resolution of a cathode ray tube by increasing the gap between the main electron beam condensing electrodes of the gun, and thus forming a floating electrode without any applied voltage, in a color cathode ray tube with an in-line-type electron gun.

In the conventional cathode ray tube as shown in FIG. 1, a screen 2 is formed in front of a tube 1, and a shadow mask 3 and a supporting frame 4 for supporting it are installed into the interior of the tube, to the rear of screen 2. An electron gun 5 for projecting an electron beam is installed at the back of the tube 1, and a deflecting yoke 6 is installed in front of the electron gun 5.

If an electron beam is projected from the electron gun 5, the deflecting yoke 6 deflects the electron beam. Then, the electron beam is in collision with the screen 2 by passing through numerous holes formed through the shadow mask 3, so as to form an image.

Thus, the electron gun 5 in the cathode ray tube relies on provision and use of an apparatus for condensing the electron beam projected from its cathode 16 as shown in FIG. 2. This conventional condensing apparatus has first to fourth electrodes 10–13, which are spaced axially apart from one another by respective predetermined gaps and are fixedly supported by bead glasses 14 and 15. As shown in FIG. 3, a pre-focusing lens a is formed by a voltage difference between the second and third electrodes 11 and 12, while an electro-static lens b is formed by a voltage difference between the third and fourth electrodes 12 and 13. Thus, the electron beam passing through the pre-focusing lens a is again condensed on the screen by passing through the electro-static lens b.

However, because the spherical aberration of the electro-static lens b caused by the voltage difference of the third and fourth electrodes 12 and 13 is large, the refractive index of the lens b is varied according to the spherical surface, and thus it is difficult for the electron beam to focus on a point. Also, when the gap between the third and fourth electrodes 12 and 13 is widened to reduce the spherical aberration, an magnetic repulsion effect is generated at the edge of the electro-static lens b by the interference of electric potential induced at the bead glasses 14 and 15, thereby causing deformation of the electro-static lens b. As a result, the convergence of the R(red), G(green), and B(blue) electron beams is varied, depending on time. Thus, the gap between the third and fourth electrodes 12 and 13 can not be widened beyond a predetermined value.

Accordingly, in order to overcome this problem, various methods for increasing the size of the electro-static lens b have been employed. There are two particularly noteworthy methods, of which one enlarges the electro-static lens by enlarging the diameter of the longitudinal central bore of the electrodes, and the other obtains the enlarged hole effect by modifying the composition of the electrical potential of the electrodes. However, in both methods, there is imposed a limit by the sizes of the products, and therefore, a focusing voltage difference between the center and the edge of the electron beam is produced.

SUMMARY OF THE INVENTION

The present invention is intended to overcome the above-described disadvantages of the conventional techniques.

Therefore, it is an object of the present invention to provide an electron gun for a cathode ray tube for enlarging an electro-static lens by increasing a gap between the electron beam condensing and accelerating electrodes of the electron gun, i.e., the third and fourth electrodes, which to form a main focusing lens for condensing the electron beam projected from the cathode, and for improving the picture quality of the cathode ray tube by reducing spherical aberration.

In achieving the object, the electron gun for the cathode ray tube according to the present invention, which has first to fourth electrodes, each for applying a respective different voltage and for condensing the electron beam projected from the cathode of the electron gun, comprises a floating electrode disposed between two predetermined electrodes without applying a voltage thereto, thereby increasing the size of the electro-static lens.

DETAILED DESCRIPTION OF THE PREFERRED EMBODIMENTS

A first preferred embodiment of the present invention is described with reference to FIGS. 4 and 5 of the drawings.

Figure 1:
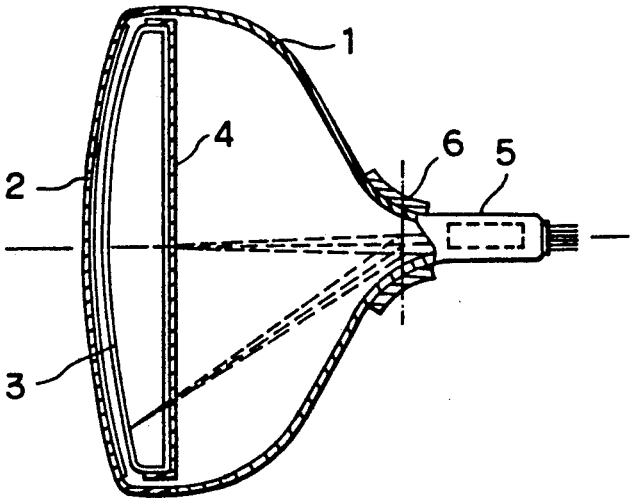
FIG. 1 PRIOR ART
FIG. 1 is a schematic diagram of a conventional cathode ray tube, which is shown partly broken away and in longitudinal cross-section.
Figure 2:
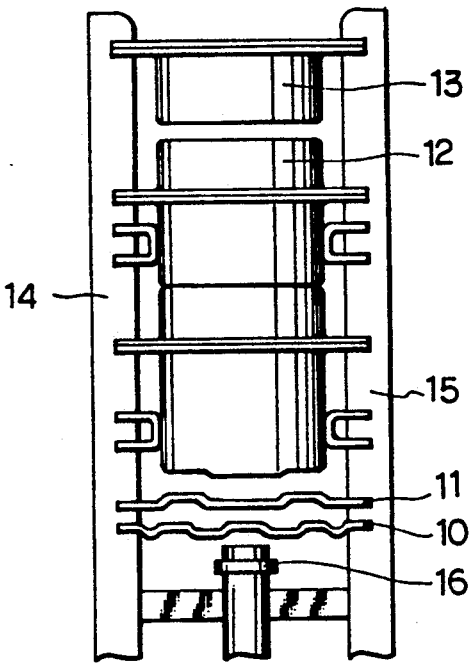
FIG. 2 PRIOR ART
FIG. 2 is a fragmentary top plan view, on an enlarged scale, of the conventional electron gun of the cathode ray tube of FIG. 1.
Figure 4:
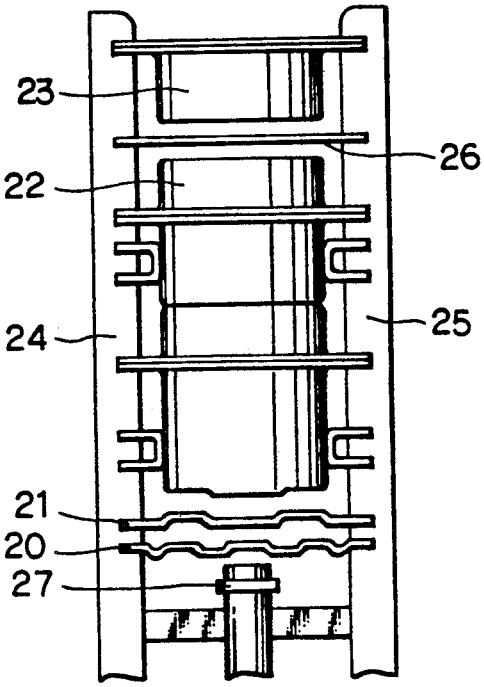
FIG. 4 is a top plan view of an electron gun according to the present invention.
Figure 3:
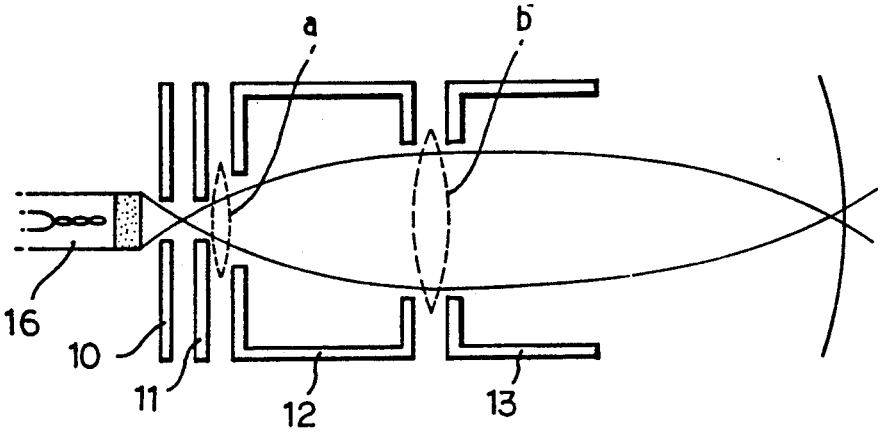
FIG. 3 PRIOR ART
FIG. 3 is a flow diagram of an electron beam projected from the conventional electron gun of FIG. 2.

FIG. 4 shows an electron gun for a cathode ray tube according to the first embodiment of the present invention. As shown in FIG. 4, first to fourth electrodes 20–23, each for applying a respective different voltage, are disposed in front of a cathode 27 for projecting an electron beam at predetermined distances therebetween, and are fixed to bead glasses 24 and 25. Further, a floating electrode 26 without having any voltage applied thereto is installed between two predetermined electrodes. (The predetermined electrodes are indicated as being the third and fourth electrodes 22 and 23 in this embodiment.)

Figure 6:
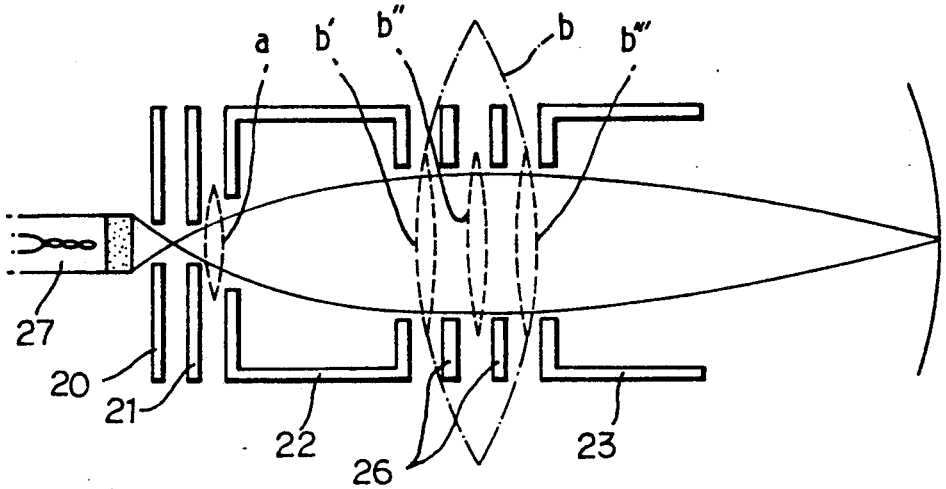
FIG. 6 is a flow diagram of an electron beam projected from an electron gun of another embodiment according to the present invention.

Alternatively, according to a second embodiment, which is shown in FIG. 6, a plurality of the floating electrodes 26 having no applied voltage, can be installed between the third and fourth electrodes 22 and 23 another and from the electrodes axially of the gap so that the gap between the third and fourth electrodes 22 and 23 can be increased in axial dimension.

Figure 5:
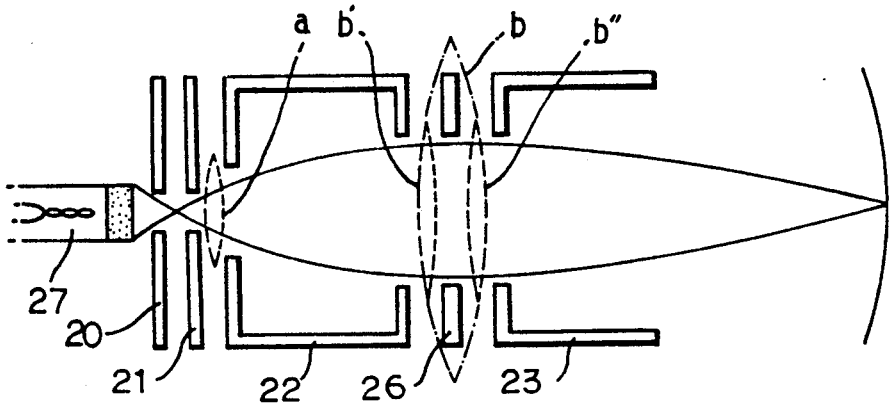
FIG. 5 is a flow diagram of electron beam projected from an electron gun according to the present invention.

When the electron beam projected from the cathode of the electron gun is condensed as shown in FIG. 5, since the voltage which is not applied between the third and fourth electrodes 22 and 23 is applied to the floating electrode 26 for applying the middle voltage of the third and fourth electrodes 22 and 23 electrically and potentially, the interference due to an electrical potential induced at the bead glasses 24 and 25 is eliminated. A lens b' is formed between the third electrode 22 and the floating electrode 26, and another lens b'' is also formed between the floating electrode 26 and the fourth electrode 23, so that an electro-static lens b formed by the composite effect of these lenses b' and b'' between the third and fourth electrodes 22 and 23 is enlarged. Thus, as shown in FIG. 6, the greater the number of floating electrodes 26 which are disposed in the gap between the third and fourth electrodes, the larger the gap between the third and fourth electrodes 22 and 23 can be, so that the size of the electro-static lens b can be further enlarged.

Thus, the lenses b' and b'' are respectively formed between the third electrode 22 and the floating electrode 26 as well as between the third electrode 22 and the fourth electrode 23, thereby enlarging the electro-static lens b. Then, the electron beam focusing voltage difference between the center and the edge of the electro-static lens is reduced and the spherical aberration according to the refractive index difference along the spherical surface is largely reduced. Thus, the electron beam is more sharply focused on a point of the screen.

As mentioned hereinabove, the electron gun for the cathode ray tube according to the present invention enlarges the electro-static lens by installing at least one floating electrode between the third and fourth electrodes. As a result, the gap between the third and fourth electrodes can be increased, so that the focusing voltage difference can be greatly reduced and the amount of the spherical aberration can be reduced, thereby improving the resolution of the cathode ray tube.

What is claimed is:

1. An in-line-type electron gun for a color-displaying cathode ray tube, comprising:

a cathode for emitting a beam of electrodes towards a screen;

a series of beam-condensing electrodes arranged in axial alignment in a series in front of said cathode; said electrodes including a first set of two electrodes having a first difference in voltage applied thereto for thereby effectively providing a prefocusing lens for said electron beam; said electrodes further including a second set of two electrodes, axially neighboring one another in said series with a gap located axially between them, said electrodes of said second set being more distant from said cathode than said first set and having a second difference in voltage applied thereto for thereby effectively providing a spherically curved electrostatic condensing lens for said electron beam; and at least one floating electrode disposed in said gap, axially between said two electrodes of said second pair, each said floating electrode having no applied voltage.

2. The electron gun of claim 1, wherein:

said at least one floating electrode is constituted by at least two floating electrodes, said floating electrodes being axially spaced from one another in said gap.

* * * * *